United States Patent [19]

DeCamp et al.

[11] Patent Number: 4,782,426

[45] Date of Patent: Nov. 1, 1988

[54] METHOD AND APPARATUS FOR REMOVING STATIC CHARGE

[75] Inventors: Howard S. DeCamp; Oded E. Sturman, both of Northridge, Calif.

[73] Assignee: Sierracin Corporation, Sylmar, Calif.

[21] Appl. No.: 7,365

[22] Filed: Jan. 27, 1987

[51] Int. Cl.[4] ..... H05F 3/02

[52] U.S. Cl. ..... 361/218; 244/1 A; 361/222

[58] Field of Search ..... 361/218, 220, 222; 244/1 A, 129.3, 134 D, 121

[56] References Cited

U.S. PATENT DOCUMENTS

| | | | |
|---|---|---|---|
| 2,416,202 | 2/1947 | Naumann | 361/220 X |
| 3,289,060 | 11/1963 | Rubin | 244/121 X |
| 4,078,107 | 3/1978 | Bitterice et al. | 244/134 D X |
| 4,084,211 | 4/1978 | Okhotnikov et al. | 361/218 X |
| 4,128,448 | 12/1978 | Bitterice et al. | 156/166 |
| 4,246,624 | 1/1981 | Lazelle | 361/218 |
| 4,323,946 | 4/1982 | Traux | 361/218 |
| 4,415,946 | 11/1983 | Pitts | 361/212 |
| 4,590,535 | 5/1986 | Mang | 361/218 |

OTHER PUBLICATIONS

Nanevicz, "Advanced Materials Aspects and Concepts for Development of Antistatic Coatings for Aircraft Transparencies", SRI International (1973) pp. 8, 9, 27, 28.

Gallagher et al., "High Voltage, Measurement Testing and Design", John Wiley & Sons, N.Y. (1983) p. 216.

SRI International Proposal for Research No. ETC 78-73, pp. 1-5 (1978).

Sharp, "Aircraft Engineering", (Jul., 1969), pp. 3-7.

Haase, "Electrostatic Hazards, Their Evaluation and Control", Verlag, Chemic GmbH, New York, (1976), pp. 8-9 and 62-63.

Lighting and Transients Research Institute Report No. 524.

Presson, Progress Update—Electrically Heated Windshields, Society of Automotive Engineering, Inc., West Coast Int. Mtg., L.A., CA, Aug. 1980.

*Primary Examiner*—L. T. Hix

*Assistant Examiner*—Brian W. Brown

*Attorney, Agent, or Firm*—Sheldon & Mak

[57] ABSTRACT

Apparatus and method for efficiently and economically reducing and removing static charge from a surface of a dielectric material. One device is a window assembly comprising a window having an outer surface and a perimeter. The outer surface comprises a dielectric material. A frame is around the window and houses the perimeter. The frame has an outer surface which terminates along the outer surface of the window at a border. At least one corona point is attached to the window assembly proximate the border. Means for grounding the corona point is in electrical communication with the corona point. The number of corona points required to dissipate the static charge is minimized by a method that locates arc attracting regions and installs the corona points proximate these regions. Also provided are a corona point assembly and a kit comprising (1) the corona point assembly and (2) means for attaching the corona point assembly to the frame.

38 Claims, 2 Drawing Sheets

METHOD AND APPARATUS FOR REMOVING STATIC CHARGE

BACKGROUND

The present invention is directed to an apparatus and method for removing or significantly reducing accumulation of static charge on a surface of a dielectric material such as an aircraft window.

Windows used in aircraft typically include several glass and/or plastic layers or plies which are fused or laminated together to form a composite transparent window. Plastics are used in the construction of aircraft windows because of their low density and consequent light weight. This light weight is particulariy important in smal aircraft where the weight of the windows can be significant relative to the overall weight of the aircraft.

In order to remove fog, mist, and ice deposits on the outboard surface of the window during flight, aircraft windows can include an internally located electrical device for heating the window. Static electric charge can also collect on the outboard surface of an aircraft window during flight. This build up of static charge is due to triboelectric charging. If allowed to build up, the static charge often reaches an electrical potential sufficient to discharge through or across the window to the interior heating device or to a conductive material adjacent to the window, e.g., a window frame.

This electrical discharge can puncture small holes in the window, cause radio frequency interference, ang be very distracting. In extreme cases depending upon the construction of the wingow, a high voltage gischarge can result in sufficient localizeg heat to gamage the Wingow in the vicinity of the gischarge path by causing 1nterlayer gelamination. Further, when the discharge is through the heating device, the device can be severely damaged. It is therefore desirable to dissipate the static charge before it reaches an electric potential sufficient to damage the aircraft window or the aircraft.

One method for preventing static charge buildup on the outboard surface of an aircraft window is to coat the outboard window surface with an electroconductive anti-static coating. Transparent electroconductive coatings of metal or metal oxide materials of suitable electroconductivity have been successfully applied to glass plies to provide an anti-static coating on the outboard surface of the window. However, even though such coatings work well on glass, they are not practical for use on plastic window surfaces. Presently available anti-static coatings which can be applied at temperatures suitable for plastic plies do not provide the necessary combination of optical transparency, electroconductivity, and durability in service.

Moreover, anti-static coatings have additional drawbacks when used on plastic surfaces in that plastics are more likely than glass to develop scratches and other mars which interfere with visibility. Consequently, windoWs having an outboard plastic ply must be cleaned and polished periodically to restore their smooth transparent surface. This polishing can eventually remove any presently known anti-static coating applied to the outboard surface of a window.

Another technique for removing static charge is disclosed in U.S. Pat. No. 4,590,535. This patent discloses a device for dissipating static charge collected on the surface of a laminated aircraft window having an outboard plastic ply. The device includes a plurality of electroconductive static charge collecting wicks extending through the thickness of the outboard ply from the outboard surface of the gly to its inboard surface where the wicks are interconnecteg by wick runs adapted for conection to ground. However, this device cannot be retrofitted to existing airplane windows. It is only useable with new windows, thereby requiring the replacement of the entire window in existing aircraft. This can be very costly. In addition, this device has a complex structure which renders it expensive.

Accordingly, there is a need for a technique for effectively and economically dissipating static electrical charge from the surface of dielectric material, and especially from the outboard plastic surface of an aircraft window, which does not have the drawbacks or limitations of presently available techniques.

SUMMARY

The present invention satisfies this need by providing (a) a method for removing static charge from a surface of a dielectric material, b) a method for manufacturing an assembly comprisin a dielectric material and means for dissipating static charge from the surface, (c) a corona point assembly and a kit for use in removing precipitation static from a window, and (d) a window assembly having at least one corona point attached to the window. By use of the methods and devices of the present invention, static charge is effectively dissipateg from the surface of dielectric materials, and especially from the outboard plastic surface of an aircraft window, in a cost effective manner that can be used in conjunction with both new aircraft windows and presently installed aircraft windows.

According to this invention, static charge is removed from a surface of a dielectric material such as aircraft windows. The surface has a perimeter and an electrically conductive material which is proximate to at least a portion of the perimeter. The method comprises the steps of locating at least one arc attracting region on the electrically conductive material and installing at least one grounded corona point proximate to the located arc attracting region. As used herein. an "arc attracting region" is an area of the electrically conductive material proximate the surface of the electric material which tends to attract at least one electrical arc or streamer emanating from the surface of the dielectric material.

The corona point comprises a tip, a base, and a body connecting the tip and the base. By locating an arc attracting region and placing the corona point proximate the located arc attracting region, static charge is effectively dissipated. To more efficiently dissipate static charge from the surface of dielectric materials, it is preferred that the tip of the corona point be above and spaced apart from the surface of the dielectric material. An exemplary spacing is from about 0.005 to about 0.4 inch.

An assembly incorporating the corona point can be prepared by the steps of (a) placing the dielectric material in an electrically conductive frame; (b) grounding the frame; (c) after step (a), depositing sufficient static electricity on the surface of the dielectric material that the dielectric material discharges an electric arc; (d) locating at least one arc attracting region by observing at least one region proximate the electrically conductive frame which attracts an electric arc when the dielectric material discharges the electric arc; (e) positioning at least one corona point proximate the located arc attracting region; and (f) grounding the corona point.

Generally this method locates more than one arc attracting region. A corona point need not be installed proximate each located arc attracting region. Instead, only one corona point can be installed proximate a plurality of located arc attracting regions. By installing one corona point proximate a plurality of located arc attracting regions, static electrical charge is dissipated from the surface without the formation of an electric arc. Furthermore, if by chance an arc does form, damage to the window is eliminated because the arc goes to a grounded corona point.

The steps of positioning and grounding the corona point can be performed simultaneously by employing an electrically conductive material to attach the corona point proximate the arc attracting region.

The tip of the corona point is preferably oriented away from the electrically conductive material and toward an internal region of the surface. This orientation improves the attraction between the tip of the corona point and charged particles or plasma above the dielectric surface.

A window assembly prepared according to this method comprising (a) a window having an outer surface comprising a dielectric material; (b) a frame around the window for housing the dielectric material, the frame having an outer surface which terminates along the outer surface of the dielectric material at a border; (c) at least one corona point attached to the window assembly proximate the border; and (d) means for grounding the corona point, the grounding means being in electrical communication with the corona point. For example, in one window assembly embodying features of this invention, the grounding means is in electrical communication with the corona point and the frame. In order for the window assembly to dissipate static electricity efficiently, it is preferreg that the window assembly have a plurality of corona points.

To prevent leakage of pressurizeg cabin air as well as seepage of fluids, e.g., water and air, the window assembly has a seal along its border and in physical contact with the frame and the outer surface of the dielectric material. It is preferred that the tip of the corona point be positioned as close to the center of the dielectric material surface, i.e., the source of static electricity, as possible without the corona point obstructing or distracting the vision of a person looking through the window. Accordingly, the corona point is preferably positioneg proximate the border in the area occupied by the edge seal.

Preferably, the corona point is also positioned proximate an arc attracting region. This positioning technique greatly enhances the static charge dissipating ability of the positioned corona point. In addition, to minimize the number of corona points, only one corona point is positioned proximate a plurality of closely located arc attracting regions.

A preferred corona point assembly for use in removing precipitation static from a dielectric material comprises a) a corona point and (b) a hollow, elongate housing for protecting the corona point from damage and from injuring personnel during dielectric material maintenance procedures. The housing at least partially encloses the body of the corona point and has an open end. The tip of the corona point is positioned proximate the open end of the housing. The corona point assembly further comprises means for grounding the corona point wherein the grounding means is in electrical communication with the corona point.

To improve the static charge dissipating efficiency of the corona point assembly, it is further preferred that the corona point taper to a sharp point at its tip. In an exemplary corona point assembly, the open end of the housing is slanted and at least a portion of the tip protrudes from the open end of the housing. This slanted open end further protects the corona point from damage and from injuring personnel while exposing as much of the tig as possible. In order to maximize the efficacy of the corona point assembly of this embodiment, it is also preferred to position the tip of the corona point between the open end of the housing and a terminus of the housing. For the same reason, it is also preferred that the corona point physically contact the housing at a location other than the open end of the housing.

Furthermore, the present invention is also directed to a kit for use in removing precipitation static from a window. The kit comprises, in association, the corona point and means for attaching the corona point assembly at a location proximate the window frame.

DRAWINGS

These and other features, aspects, and advantages of the present invention will become better understood with reference to the following description, appended claims, and accompanying drawings where:

DESCRIPTION

Figure 1:
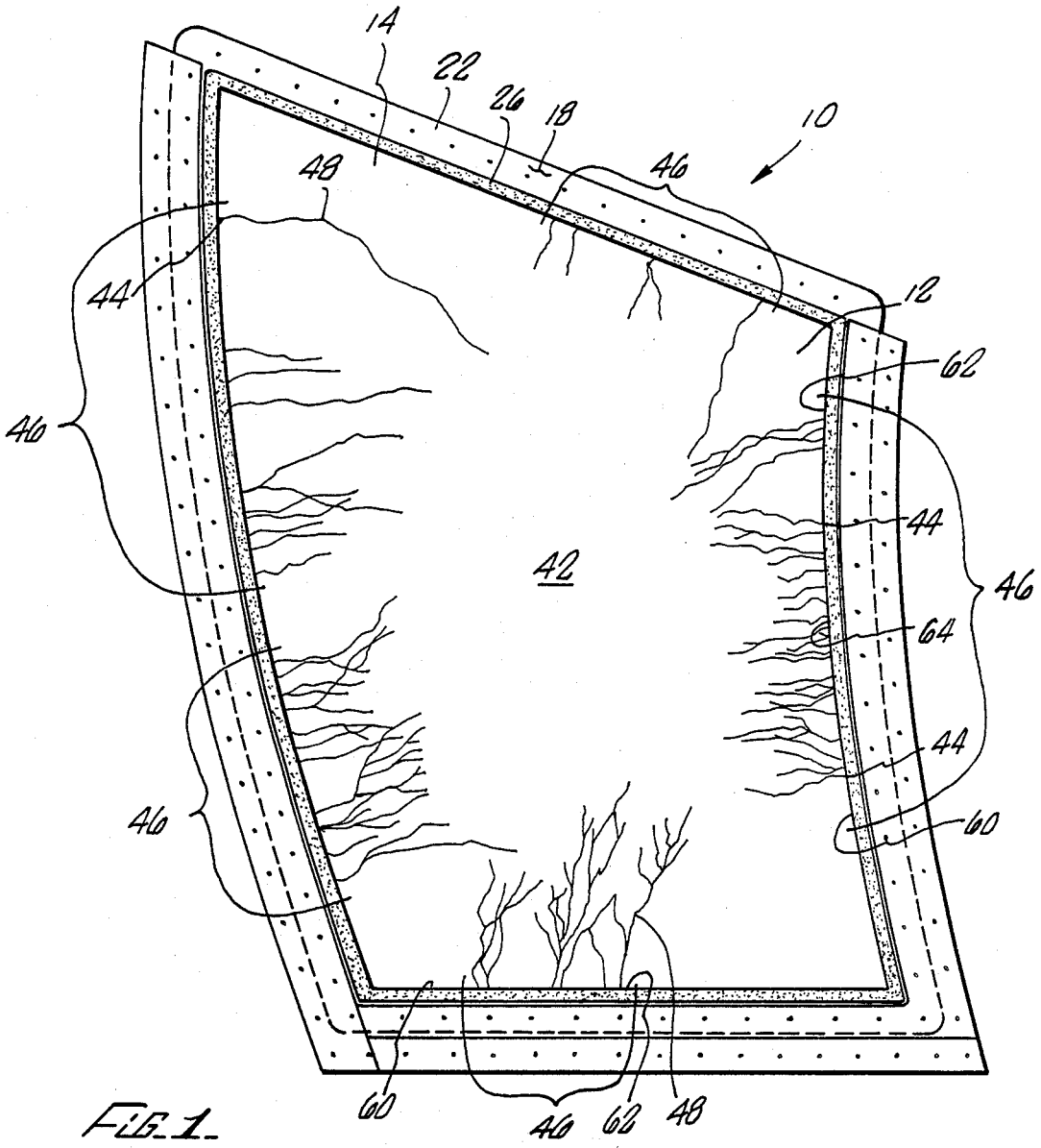
FIG. 1 is an elevation view of a talc-dusted face of a windshield having discharge arc tracks recorded in the talc dust.
Figure 5:
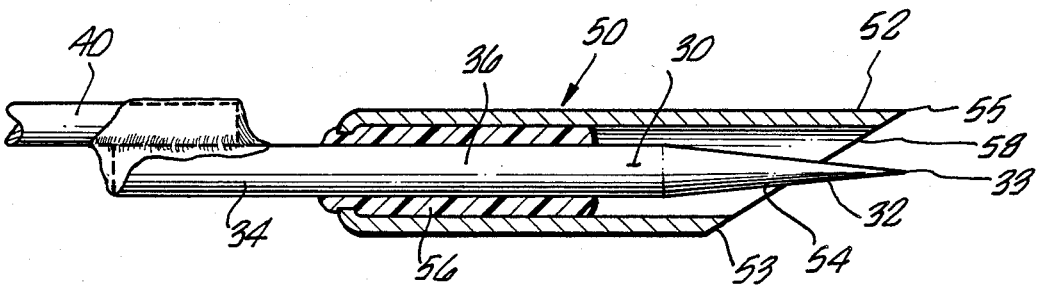
FIG. 5 is a planar sectional view of a second corona point assembly embodying features of the present invention.

The present invention is directed to (a) a method for removing static charge from a surface of a dielectric material; (b) a method for manufacturing an assembly comprising a dielectric material and means for dissipating static electricity from the surface of the dielectric material; (c) a corona point assembly and kit for use in removing static charge from a dielectric material; and (d) a window assembly having at least one corona point assembly attached to the window. The methods and devices of this invention can be employed to prevent destructive random electrical arcing from the surface of dielectric materials such as aircraft and other windows.

With reference to the figures, the present invention provides a window assembly 10 having an effective and economical means for removing static charge from an outboard or outer surface 12 of a window 14. The window 14 is made of a dielectric material. The dielectric material can be, but is not limited to, glass, plastic, and materials containing one or more layers or plies 15 of glass or plastic or combinations of glass and plastic. The layers are optionally fused or laminated together. An exemplary dielectric material is an aircraft laminate.

The window 14 has a perimeter 16 and a frame 18 for the window 14. The frame 18 has a U-shaped channel 20 for receiving the perimeter 16 of the window 14. The frame 18 is typically made of an electrically conductive material. Conductive materials include, but are not limited to, aluminum, stainless steel, titanium, and conductive alloys.

To prevent leakage of fluids into or out of the frame 18, it is preferred that the window assembly 10 further comprises a sealant 26 at the border 24 between the window 14 and the frame 18.

The window assembly 10 also comprises at least one corona point 30 attached to the window assembly 10 proximate the border 24. The corona point comprises a tip 32, a base 34, and a body 36 which connects the tip 32 and the base 34. Preferably the tip 32 is above and spaced apart from the outer surface 12 of the window 14. This preferred embodiment significantly improves the static dissipating efficiency of the corona point 30 as compared to a corona point 30 having its tip 32 in contact with the outer surface 12 of the window 14. An exemplary spacing between the end 33 of the tip 32 and the outer surface 12 is about 0.005 to about 0.4 inch. The corona point 30 is made of an electrically conductive material such as those discussed above. The corona point 30 is attached to the window assembly 10 by attachment means 38, such as adhesives, cements, and spot welding. The attachment means 38 can be electrically conductive or electrically nonconductive.

The corona point 30 is grounded by means such as an electrically conductive attachment means 38 or an electrically conductive lead 40. In one embodiment of the present invention, the corona point 30 is grounded to the frame 18.

The tip 32 of the corona point 30 is positioned such that it carries charged particles or plasma above the outer surface 12 of the window 14. To enhance this effect between the tip 32 of the corona point 30 and the plasma, it is preferred that the corona point 30 be positioned with its tip 32 pointing away from the frame 18 and inwardly towards an interior region 42 of the outer surface 12 of the window 14.

In general, in order to eliminate damaging electrical arcs, a plurality of corona points 30 are positioned around the frame 18 proximate the border 24 such that the static charge is dissipated from the surface 12 without the formation of an electrical arc. However, although not preferred, the electrical charge can be dissipated from the surface 12 by the formation of one or more electrical arcs to only one or more of the corona points 30. In this embodiment, distracting electric arcs are still generated. Nevertheless, since these arcs go only to the corona points 30, these electrical arcs do not cause any damage to the window apparatus 10 or any adjacent material.

To further enhance the ability of the corona point 30 to dissipate static charge from the outer surface 12 of the window 14, it is preferred that the tip 32 of the corona point 30 be positioned as close as possible to interior region 42 of the window from where the electrical arc originates. In so positioning the tip 32, it is also preferred to position the corona point 30 so that it does not obstruct the vision of the person looking through the window 14. Accordingly, preferably the corona point 30 is positioned in the sealant 26 with the end 33 of its tip 32 In a plane that intersects a boundary 29 between the sealant 26 and the window 12 at a right angle with respect to the outer surface 12 of window 14. in this embodiment, the sealant 26 can also attach the corona point 30 to the window assembly 10 and thereby act as an alternative attachment means.

It has also been discovered that by strategically positioning the corona points 30 around the frame 18, the number of corona points 30 placed can be minimized. More particularly, it has been discovered that for a given window apparatus configuration, the window apparatus 10 has one or more arc attracting regions 44. Arc attracting regions 44 are the areas of the electrically conductive frame 18 proximate the surface 12 of the window 14 which tend to attract at least one electrical arc or streamer from the surface 12 of the window 14. Furthermore. it has been discovered that a corona point 30 need not be positioned proximate each arc attracting region 44 in order to efficiently dissipate static charge from the window apparatus 10. Instead, one corona point 30 can be positioned proximate a plurality of arc attracting regions 44. By positioning a single corona point 30 proximate a plurality of arc attracting regions 44, the number of corona points 30 required to eliminate the electrical discharge is substantially reduced.

A number of methods can be used to determine the arc attracting regions 44. In one method a probe or a current meter is moved around the perimeter 16 to gauge energy delivered to various locations. Preferably, this method is not used because it is cumbersome. Furthermore, this method is also dangerous due to the high voltages involved. In another method, a photographic record of the electrical arcs can be accumulated. However, this latter method is time consuming and rather costly.

In a preferred method of the present invention, finely divided, non-conductive particles are used to record the number and direction of electrical arc paths or tracks 48. Non-conductive particles include, but are not limited to talc.

In this preferred method, the finely divided particles are dusted on the surface 12 of the window 14 prior to charging the window 14 with static electricity. The finely divided, non-conductive particles appear to have no effect on the electrical properties of the surface 12 of the window 14. As a result of electrical arcs generated during testing, the tracks 48 are cleared in the finely divided particles by the arcs and these tracks 48 can be readily studied or photographed for record. In one method embodying features of the present invention a Van de Graaff generator is employed. The Van ge Graaff generator delivers static electricity in the 200 to 500 kV range typical of static charge deposited on outboard windshields by triboelectric charging under certain flight conditions. Tests are conducted at normal room (ambient) temperature and pressure. Atmospheric pressure, temperature, and the humidity at the time of testing are determined and used to correct generator output voltage measurements prior to each test. The generator's output voltage is measured by measuring the length of arcs between the generator and a grounded sphere. This voltage measurement establishes that the generator is operating properly just before charging the test window assembly 10. The window assembly 10 is charged by bringing the outer surface 12 of the window 14 close to the generator at the approximate center of the window 14. Repeated discharging by electrical arcs produce the arc tracks 48 that are recorded in the finely divided dust particles. These tracks 48 are used to locate the arc attracting regions 44. Corona points 30 are then placed, one by one, proximate the arc attracting regions 44 and the charging test is repeated as many times as is necessary to determine the position and minimum number of corona points 30 necessary to prevent streamers. This process also combines the arc ttracting regions 44 into groups 46. A single corona point 30 is capable of dissipating static charge that would otherwise strike a plurality of arc attracting regions 44. Accordingly, when properly gone, the corona points 30 prevent a single streamer from occurring no matter how the voltage fluctuates within the static charge range. Final confirmation of the optimal location of the corona points 30 is preferably made by in-flight testing. In-flight tests have confirmed the validity of the simulated laboratory testing described above.

Figure 2:
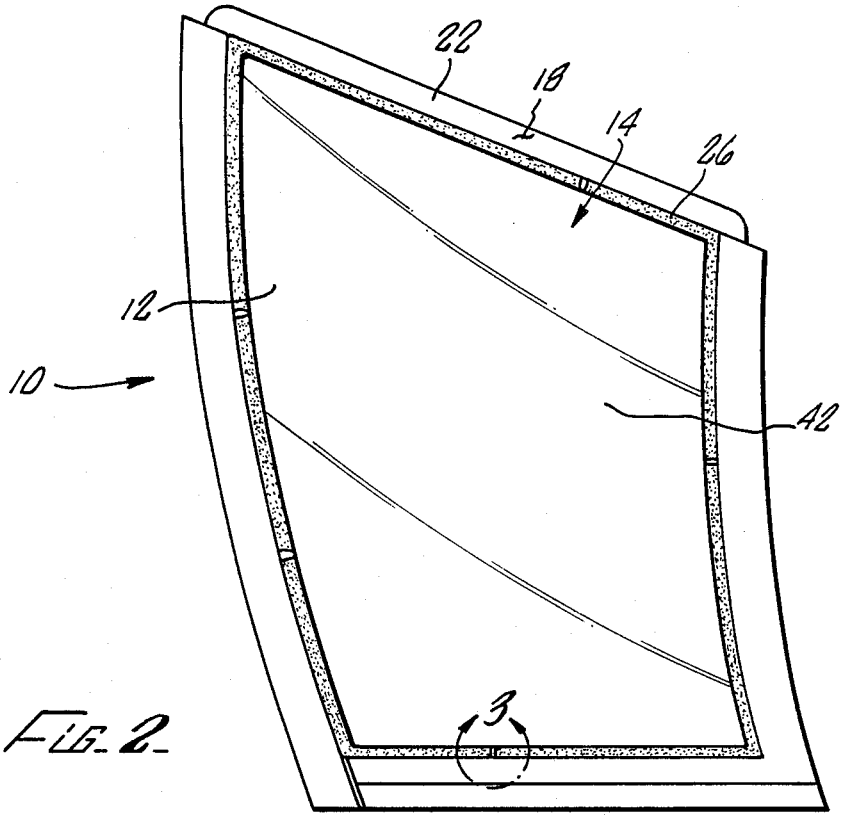
FIG. 2 is an elevation view of a window assembly embodying features of the present invention.
Figure 3:
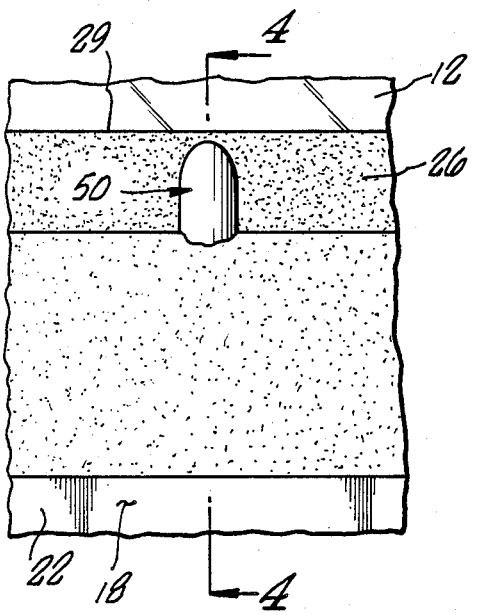
FIG. 3 is a fragmentary detailed view of the window assembly of FIG. 2 showing a corona point assembly embodying features of the, present invention within region 3 of FIG. 2.
Figure 4:
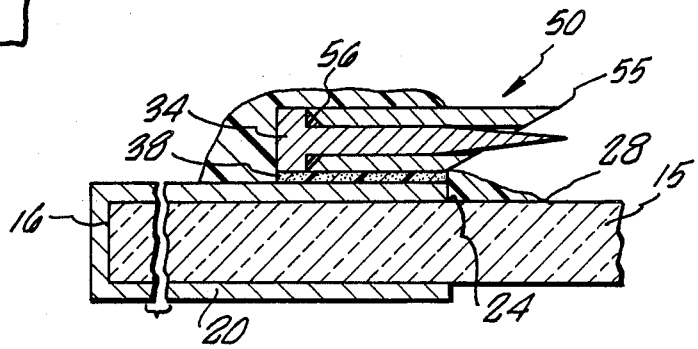
FIG. 4 is a fragmentary sectional view of the window assembly of FIG. 2 along line 4—4 in FIG. 3.

The number of corona points required to eliminate electrical arcing varies and depends upon the individual window apparatus configuration. However, substantially identical window apparatus configurations require the same number of corona points 30 positioned at the same location to eliminate destructive electrical arcing. For example, as shown in FIG. 2, a forward windshield of a small passenger jet aircraft required five corona points 30 to eliminate electric arcing. In contrast a forward windshield of a another aircraft required twenty-one corona points.

In general, the method of the present invention is applicable to windows which tend to accumulate static charge on their surface. Such windows include, but are not limited to, airplane windows, air tunnel windows, and any window exposed to environments wherein a gas passes over the window's surface at high velocities. These windows can be of any size and shape. However, because the problem of static charge removal intensifies with increasing window surface area, the present invention is particularly applicable to windows having a surface area greater than about four square feet.

In one embodiment of the present invention, the corona point 30 is part of a corona point assembly 50. The corona point assembly 50 comprises a hollow cylindrical, elongated housing 52 for mounting and protecting the corona point 30 from damage and from injuring personnel during window maintenance procedures. The housing has an open end 53 through which the tip 32 of the corona point 30 protrudes. The housing 52 can be electrically conductive or electrically nonconductive. The body 36 of the corona point 30 is at least partially, and preferably totally, enclosed by the housing 52. The corona point 30 is positioned inside the housing with the tip 32 of the corona point 30 positioned proximate the opening 58.

To improve the static charge dissipating characteristics of the corona point 30, the tip 32 of the corona point 30 preferably tapers to a point 33. For the same reason, it is also preferred that the open end 53 of the housing 52 be slanted. The slanted open end 53 of this embodiment of the invention further grotects the corona point 30 from damage while enabling the tip 32 of the corona point 30 to protrude from the open end 53 of the housing 52 and thereby be better exposed to static charge. For ease of manufacturing, it is preferred that the slanted open end 53 of the housing 52 be planar.

In order to further maximize the efficiency of the corona point assembly 50 the tip 32 of the corona point 30 is preferably positioned approximately between the open end 53 of the housing 52 and a terminus 55 of the housing 52. For the same reason, it is preferred that a surface 54 of the corona point 30 physically contacts the housing 52 at a location other than the open end 53 of the housing 52. The corona point 30 is maintained in a fixed relationship with the housing 52 by various techniques which include but are not limited to, press fitting, the use of an adhesive cement 56, and welding.

In addition to being capable of being installed in new windows, e.g., aircraft windshields, the corona point assemblies 50 can be retrofitted into windshields and other windows already installed in aircraft. To accomplish this the present invention provides a kit which comprises, in association the corona point assembly 50 and the attachment means 38. In addition the kit optionally comprises grounding means.

The corona point assembly 50 can be attached to a presently installed aircraft window by the attachment means 38. For example, in one method embodying features of the present invention, a portion of the sealant 26 is removed from the window apparatus 10 to expose the frame 18. The corona point assembly 50 is then positioned at this location and affixed to the frame 18 by an electrically conductive attachment means 38 such as electrically conductive cement which also acts to ground the corona point 30 to the frame 18. The sealant 26 is then reapplied to the region. Accordingly, the corona point assembly 50 and kit of the present invention are extremely useful in modifying existing aircraft windshields in a simple, efficient and very inexpensive manner.

EXAMPLE

In this example a method for locating arc attracting regions is described. In addition, this example demonstrates how to eliminate streamers or arcs through the positioning of corona points at a plurality of the arc attracting regions.

A Van de Graaff generator was employed in tests to change a forward windshield 10 of a jet airplane. See FIG. 1. The forward windshield 10 comprised the following successive layers: (a) a 0.064 inch thick face or outer ply of as-cast acrylic having a vacuum deposited transparent gold resistance heater layer on the inner surface of the face ply; (b) a 0.010 inch thick polyvinyl butyral (PVB) inner layer; a 0.700 inch thick stretch acrylic layer; (d) a 0.050 inch thick PVB inner layer, and (e) a 0.350 inch thick stretched acrylic inner or inboard ply. Tests were conducted at room ambient) temperature and pressure. Atmospheric pressure, air temperature, and humidity at the time of testing were determined and used to correct generator output voltage measurements prior to each test. The generator output voltage was measured by measuring the lenth of arcs between the generator and a grounded sphere This voltage measurement verified that the generator was operating properly just before charging the test windshield 10.

Finely divided talc was dusted on the outboard surface 12 of the windsheild 10. The test windshield 10 was charged by bringing the outboard surface 12 of the windshield 10 close to the generator. The generator was positioned at the approximate center of the windshield 10. Repeated charging at 500 kV and discharging by electrical arcs produced are tracks 48 which were recorded in the finely divided talc. These tracks 48 were used to locate the arc attracting regions 44. Corona points 30 were first placed at each end 60, 62 and in the middle 64 of each group 46 of arc attracting regions 44. The corona points 30 were placed on the sealant 26 and held in place by applying a polysulfide sealant over each corona point 30. Care was taken to not cover the tip 32 with the polysulfide sealant. The tips 32 were each spaced approximately about 1/32 to about 1/16 inch above the surface 12 of the windshield 10. The corona points 32 were grounded to the frame via a braided wire.

The windshield 10 was then charged at 500 kV and discharged. No electrical arc was produced. One of corona points 30 at the end of one of the groups 46 was then removed. This sequence was repeated without the formation of any electrical arc until all of the end corona points 30 were removed from the windshield 10. However, when any one of the five corona points 30 at the middle of any one of the arc attracting groups was subsequently removed, electrical arcs formed upon the charging and discharging of the windshield 10. Accordingly, for the forward windshield 10 of a typical jet aircraft, a minimum of five corona points 30 are required to prevent the formation of electrical arcs. See FIG. 2.

This example demonstrates a technique employing finely ground non-conductive particles to locate arc attracting regions 44 and the positioning of corona points 30 proximate to such regions in a manner such that static charge is dissipated without the formation of electrical arcs.

Accordingly, the methods and apparatus of the present invention prevent the occurrence of arcs or streamers which travel over the outer surface of a dielectric material, such as an aircraft windshield. In addition, the present invention reduces the intensity of radio frequency static. These results are achieved because the static charge is continually drawn off. Furthermore, these results are achieved in an economical manner and do not require that existing windshield assemblies be either replaced or even significantly modified. Accordingly, the present invention solves a problem which has perplexed the aircraft industry, in an uncomplicated and extremely cost effective manner.

Although the present invention has been described in considerable detail with refernce to certain preferred versions thereof, other versions are possible. For example, corona points other than those described in the preferred embodiments of the present invention can be employed in the methods and window apparatus of this invention. Therefore, the spirt and scope of the appended claims shouldnot necessarily be limited to the description of preferred versions contained herein.

What is claimed is:

1. A method for removing static charge from a surface of dielectric material, the surface having a permiter and an electrically conductive material proximate at least a portion of the perimeter, the method comprising the steps of:

(a) locating at least one arc attracting region on the electrically conductive material and proximate a border between the dielectric material and electrically conductive material;

(b) installing a corona point proximate (i) the located arc attracting region and (ii) the border; and (c) grounding the corona point so that the corona point dissipates static charge from the surface of the dielectric material, the arc attracting region being an area of the electrically conductive material proximate the surface of the dielectric material which attracts at least one electrical arc or streamer emanating from the surface of the dielectric material.

2. A method for manufacturing an assembly comprising a dielectric material and means for dissipating static charge from a surface of the dielectric material, the dielectric material having a perimeter, the method comprising the steps of:

(a) placing at least a portion of the perimeter in an electrically conductive frame;

(b) grounding the frame;

(c) after step (a), depositing sufficient static electricity on the surface of the dielectric material that the dielectric material discharges an electric arc;

(d) locating at least one arc attracting region by observing at least one region on the electrically conductive frame and proximate a border between the dielectric material and the electrically conductive frame which attracts an electrical arc when the dielectric material discharges the electric arc;

(e) installing a corona point on the assembly and proximate (i) the located arc attracting region and (ii) the border; and (f) grounding the corona point, the arc attracting region being an area of the electrically conductive frame which attracts at least one electrical arc or streamer emanating from the surface of the dielectric material.

3. The method of claim 1 wherein the dielectric material is an aircraft window and the electrically conductive material is a frame for housing the window.

4. The method of any one of claims 1 or 2 wherein the corona point comprises a tip, a base, and a body connecting the tip and the base, the tip of the corona point being above and spaced apart from the surface.

5. The method of any one of claims 1 or 2 wherein the corona point comprises a tip, a base, and a body connecting the tip and the base, the tip of the corona point being above and spaced apart from the surface by about 0.005 to about 0.4 inch.

6. The method of claim 1 wherein the step of locating comprises locating a plurality of arc attracting regions on the electrically conductive material and proximate the border.

7. The method of claim 2 wherein the step of locating comprises locating a plurality of arc attracting regions on the electrically conductive frame and proximate the border.

8. The method of claim 6 or 7 wherein the step of installing comprises installing only one corona point proximate the border and a plurality of arc attracting regions.

9. The method of claim 8 wherein static charge is dissipated from the surface without the formation of an electric arc.

10. The method of claim 8 wherein static charge is dissipated from the surface by the formation of at least one electrical arc to only one or more of the corona points.

11. The method of claim 1 or 2 wherein the steps of installing and grounding the corona point are performed simultaneously by using an electrically conductive material to attach the corona point proximate (i) the located arc attracting region and (ii) the border.

12. The method of claims 2 or 3 wherein the corona point is in electrical communciation with the frame.

13. The method of claim 2 or 3 wherein the corona point comprises a tip, a base, and a body connecting the tip and the base, and the step of installing the corona point comprises the step of orienting the tip away from the frame and toward an interior region of the surface.

14. The method of claims 1 or 2 wherein the installed corona point is substantially immobile.

15. The method of claims 1 or 2 wherein the step of installing comprises installing a plurality of corona points, each corona point being installed proximate (i) the border and (ii) at least one located arc attracting region.

16. A window assembly comprising:

(a) a window having an outer surface and a perimeter, the outer surface comprising a dielectric material;

(b) a frame around the window for housing the perimeter, the frame having means for retaining the window in the frame;

(c) at least one corona point attached to the window assembly proximate a border between the window and the frame, each corona point being positioned substantially outside the window or static generating area; and (d) means for grounding the corona point, the grounding means being in electrical communication with the corona point.

17. The window assembly of claim 16 wherein the corona point comprises a tip, a base, and a body connecting the tip and the base, the tip of the corona point being above and spaced apart from the outer surface of the window.

18. The window assembly of claim 16 comprising a plurality of corona points, each corona point being positioned substantially outside the window or static generating area.

19. The window assembly of claim 16 further comprising a sealant along the border and in physical contact with the frame and the outer surface of the window.

20. The window assembly of claim 19 wherein the corona point is located in the sealant.

21. The window assembly of claim 16 wherein the corona point is substantially immobile.

22. A window assembly comprising:

(a) a window having an outer surface and a perimeter, the outer surface comprising a dielectric material;

(b) a frame around the window and for housing the perimeter, the frame having means for retaining the window in the frame;

(c) at least one corona point attached to the window assembly proximate (i) a border between the window and the frame and (ii) at least one arc attracting region, each corona point being positioned substantially outside the window or static generating area; and (d) means for grounding the corona point, the grounding means being in electrical communication with the corona point, the arc attracting region being an area of the frame which attracts at least one electrical arc or streamer emanating from the surface of the dielectric material.

23. The window assembly of claim 22 wherein the corona point comprises a tip, a base, and a body connecting the tip and the base, the tip of the corona point being above and spaced apart from the outer surface of the window.

24. The window assembly of claim 22 wherein the corona point comprises a tip, a base, and a body connecting the tip and the base, and the corona point is positioned with the tip oriented away from the frame and towards an interior region of the outer surface of the window.

25. The window assembly of claim 22 comprising a corona point positioned substantially outside the window or static generating area and proximate a plurality of arc attracting regions.

26. The window assembly of claim 22 further comprising a sealant along the border and in physical contact with the frame and the outer surface of the window.

27. The window assembly of claim 26, wherein the corona point is positioned in the sealant.

28. The window assembly of claim 22 comprising sufficient corona points such that static charge is dissipated from the outer surface without the formation of an electrical arc, each corona point being positioned substantially outside the window or static generating area.

29. The window assembly of claim 22 comprising a plurality of corona points attached to the window assembly proximate the border, each corona point being attached proximate at least one arc attracting region and positioned substantially outside the window or static generating area.

30. The window assembly of claim 22 wherein each corona point is substantially immobile.

31. A corona point assembly for use in removing static charge from a surface of a dielectric material, the corona point assembly comprising:

(a) an electrically conductive corona point comprising a tip, a base, and a body connecting the tip and the base.

(b) a hollow, elongated housing partially enclosing the body of the corona point and having an open end, the tip of the corona point being positioned proximate the open end of the housing, the open end of the housing being slanted, and the housing being adapted to be attached proximate the sruface so that (i) the top of the housing protects the corona point from damage and from injuring personnel during dielectric material maintenance procedures and (ii) the bottom of the housing leaves a portion of the corona point exposed to the surface.

32. The corona point assembly of claim 31 further comprising means for grounding the corona point, the grounding means being in electrical communication with the corona point.

33. The corona point assembly of claim 31 wherein the corona point tapers to a point at the tip of the corona point.

34. The corona point assembly of claim 33 wherein at least a protion of the tip of the corona protrudes from the open end of this housing.

35. The corona point assembly of claim 34, wherein the tip of the corona point is positioned approximately between the open end of the housing and a terminus of the housing.

36. The corona point assmebly of claim 35 wherein the corona point has a surface and the surface of the corona point physically contacts the housing at a location other than the open end of the housing.

37. A kit for use in removing static charge from a surface of dielectaric material, the dielectric material being positioned in a frame, the kit comprising in association:

(a) a corona point assembly comprising:

(i) an electrically conductive corona point comprising a tip, a base, and a body connecting the tip and the base; and (ii) a hollow, elongated housing partially enclosing the corona point and having an open end, the tip of the corona point being positioned proximate the open end of the housing, the open end of the housing heing slanted, and the housing being adapted to be attached proximate the surface so that (i) the tip of the housing protects the corona point from damage and from injuring personnel during dielectric material maintenance procedures, and (ii) the housing leaves a portion of the corona point exposed to the surface; and (b) means for attaching the corona point assembly at a location proximate to the frame.

38. The kit of claim 37 wherein the corona point assembly further comprises means for grounding the corona point, the grounding means being in electrical communication with the corona point.

* * * * *